United States Patent [19]

Lerner

[11] 4,132,459

[45] Jan. 2, 1979

[54] METHOD FOR CATHODE COATING EROSION SUPPRESSION FOR A TELEVISION TUBE

[75] Inventor: Martin L. Lerner, River Forest, Ill.

[73] Assignee: Zenith Radio Corporation, Glenview, Ill.

[21] Appl. No.: 782,140

[22] Filed: Mar. 28, 1977

[51] Int. Cl.[2] ..... H01J 9/385

[52] U.S. Cl. ..... 316/18; 316/24

[58] Field of Search ..... 316/18, 24, 30

[56] References Cited

FOREIGN PATENT DOCUMENTS 1012204 4/1952 France ..... 316/18

OTHER PUBLICATIONS

"High Vacuum Technique" by J. Yarwood, 3rd Edition 1955 see especially pp. 1–35.

*Primary Examiner*—Richard B. Lazarus

*Attorney, Agent, or Firm*—Ralph E. Clark, Jr.

[57] ABSTRACT

This disclosure depicts a novel method for use in the manufacture of a color television picture tube having a narrow neck wherein the neck has a front end joined with a flared portion of the tube and a rear end having an axially extending tubulator. The tube also has an electron gun having at least one cathode adjacent the rear end of the neck, said cathode having an electron emissive coating, a forward element adjacent the front end of the neck, and a plurality of electrodes interspaced between the cathode and the forward element. The electrodes and forward element each have at least one aperture wherein the apertures are coaxial. The apertures define a beam passageway for passing through the gun a stream of electrons emitted by the cathode during operation of the tube. The beam passageway unavoidably forms a gas conduit during evacuation of the tube. The method for suppressing erosion of the cathode coating during evacuation of the tube comprises: attaching a vacuum pump to the tube's exhaust tubulation and operating the pump in a first mode effective to evacuate the tube at a first rate during an initial pump-down phase when gas volume in the tube is highest. The pump is then operated in a second mode effective to evacuate the tube at a second higher rate during a subsequent pump-down phase when the gas volume is lower. As a result, the gas velocity through the tubulation is at all times at a low value effective to suppress erosion of the cathodes in the gun during evacuation.

3 Claims, 6 Drawing Figures

METHOD FOR CATHODE COATING EROSION SUPPRESSION FOR A TELEVISION TUBE

CROSS REFERENCE TO RELATED APPLICATIONS

This application relates to, but is in no way dependent upon, copending applications of common ownership herewith, including: Ser. No. 694,614 filed June 10, 1976 abandoned for Ser. No. 861,800 filed Dec. 15, 1977; Ser. No. 834,029, filed Sept. 16, 1977, Ser. No. 649,630 filed Jan. 16, 1976; Ser. No. 642,049 filed Dec. 18, 1975 now U.S. Pat. No. 4,032,811, issued June 28, 1977 Ser. No. 784,478 filed Mar. 21, 1977.

BACKGROUND OF THE INVENTION

This invention relates in general to the manufacture of color television picture tubes and in particular to an apparatus for suppressing erosion of the electron emissive coating on the cathode of an electron gun during manufacture of the tube. Conventionally, an electron gun used in a color television picture tube includes an electron beam source and an electron beam focus lens. The electron beam source typically comprises a heated cathode element and associated electrodes which collect electrons emitted by the cathode element and form them into a beam cross-over. The electron beam focus lens shapes the stream of electrons emitted by the cathode and focuses the beam crossover on the screen of the tube. The electron beam focus lens typically comprises electrodes at varying potentials. The forward element is the focus lens anode and typically takes the form of a cup called a "convergence" or "shield" cup.

An electron gun for use in a color television picture tube generally comprises three guns, one each for exciting red, blue and green phosphor elements on the screen of the tube. Each of the electrodes and the shield cup in the gun have three apertures, one for each of the three cathodes which emit the streams of electrons. The apertures are generally circular and the apertures for each beam lie on a common line, that is they are coaxial. The apertures in the electron gun electrodes collectively form beam passageways.

An electron gun which is used in a black and white television picture tube has only one aperture in each of the electrodes and convergence cup or shield cup. Thus there is only one stream of electrons emitted by the gun. Like the color television picture tube gun the apertures in the electrodes of the black and white gun also are coaxial.

In the manufacture of color television picture tubes or black and white picture tubes, after the tube is assembled, most of the gas, usually air, which is inside the tube must be evacuated. Conventionally, this is done by attaching a vacuum pump to a tubulator which is located at the rear of the neck of the tube. As the tube is evacuated, all of the gas which is drawn from the tube must move through the neck of the tube and thus through the electron gun situated in the tube neck. The beam passageways through the gun unavoidably act as high velocity gas conduits as the tube is evacuated. These high velocity gas conduits create a violent flow of gas over the cathodes while the tube is being evacuated. It has been observed that this violent flow of gas over the cathode causes erosion of the electron emissive coating on the cathode which may necessitate rejection of a tube or which may result in degraded performance and/or reliability of a tube.

It is common practice in the manufacture of television picture tubes to control the humidity during evacuation of the tube within a narrow dew point window. Typically the dew point is controlled between 40° F. to 50° F. If the humidity is too high the cathode coating is eroded by particles of moisture during evacuation. It is believed that the water molecules actually condense during pump down to form moisture particles. This, coupled with the high velocity at the initiation of evacuation and the violeet flow of the air through the electron gun in the neck of the tube results in serious erosion of the cathode coating. The narrow dew point window has always presented serious problems in the manufacture of color television picture tubes. The conventional factory process must be constantly and closely monitored and the dew point window shifted with the seasons of the year. The present process is so difficult as to be barely workable. Suppression of the cathode erosion would allow the dew point window to be opened up, and thus allow the same process to be used year around.

Copending application Ser. No. 784,478, filed Mar. 21, 1977 discloses a unique electron gun having at least one cathode having an electron emissive coating, a forward element and a plurality of electrodes interspaced between the cathode and the forward element. The electrodes and forward element each have at least one aperture wherein the apertures in the electrodes and forward element are coaxial and define at least one beam passageway for passing through the gun a stream of electrons emitted by the cathode during operation. The beam passageway unavoidably forms a conduit for high velocity gas when the gun is located in a narrow neck of a television picture tube and the tube is evacuated of gas through a tubulator located at the rear end of the neck. The improvement in the electron gun comprises a gas influencing element for perturbing the high velocity gas flow in the conduit at least in the region of the cathode as the tube is evacuated to suppress erosion of the cathode coating by preventing a violent flow of gas over the cathode.

This invention has general applicability and may be applied to electron gun assemblies in color television tubes as well as to electron guns in black and white tubes. The invention is known to have applicability to a television picture tube having a narrow neck utilizing either a standard type unitized in-line electron gun or a unique type of high performance electron gun disclosed in U.S. Pat. No. 3,995,194.

OBJECTS OF THE INVENTION

It is a general object of the present invention to provide an improved method for evacuating a television picture tube.

It is a more specific object of the present invention to provide a method for evacuating a television picture tube which is low cost, yet effective to suppress erosion of cathode coatings in the gun during its manufacture.

It is thus another object of the present invention to provide a method for evacuating a television picture tube which increases the yield reliability and/or performance of the containing tube.

BRIEF DESCRIPTION OF THE DRAWINGS

The features of the present invention which are believed to be novel are set forth with particularity in the appended claims. The invention together with further objects and advantages thereof may best be understood by reference to the following description, taken in conjunction with the accompanying drawings in the several figures of which like reference numerals identify like elements, and in which:

DESCRIPTION OF THE PREFERRED EMBODIMENT

This invention pertains to an apparatus for suppressing erosion of cathode coatings of an electron gun used in a televsion picture tube. This is effected by evacuating gas from the tube at a sufficiently slow rate as to prevent a gas flow in the region of the cathode at a high enough velocity to suppress erosion of the cathode coating.

Figure 1:
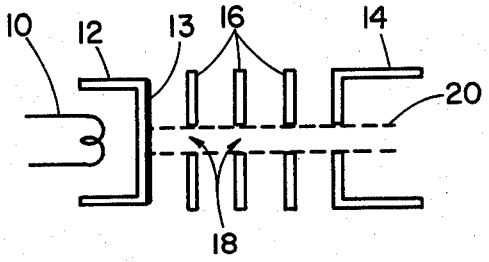
FIG. 1 is a schematic representation of an electron gun.
Figure 2:
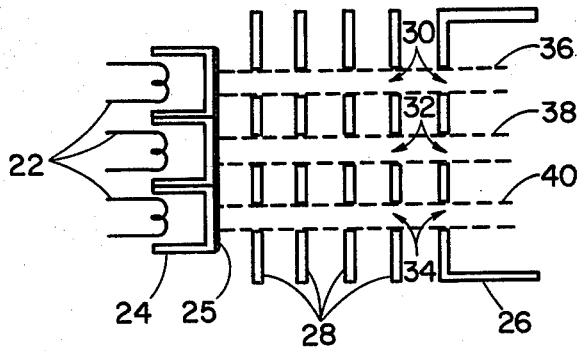
FIG. 2 is a schematic representation of an electron gun assembly used in a color television picture tube, the assembly comprising three distinct electron guns.

FIG. 1 schematically depicts a typical electron gun used in a television picture tube. The electron gun comprises at least one heater 10 and cathode 12, the cathode 12 having an electron emissive coating 13, and a forward element, such as a convergence or shield cup 14, with several electrodes 16 interspaced between the cathode 12 and the shield cup 14. The electrodes 16 and the shield cup 14 each have at least one aperture 18. These apertures 18 in the electrodes 16 and shield cup 14 are coaxial and define a beam passageway 20 for passing through the gun a stream of electrons emitted by the cathode 12 during operation of the tube. In an electron gun assembly for a color television picture tube (schematically depicted in FIG. 2), there are in actuality three electron guns. The electron gun assembly has three heaters 22 and cathodes 24, the cathodes 24 having electron emissive coatings 25, a shield cup 26 and a plurality of electrodes 28 interspaced between the three cathodes 24 and the shield cup 26. Each of the electrodes 28 and the shield cup 26 have three apertures 30, 32, 34. Arbitrarily, these apertures can be denoted first (30), second (32) and third (34) apertures which correspond to the red, blue and green electron guns. The apertures 30, 32, 34 in the electrodes 28 and shield cup 26 are coaxial are define three beam passagways 36, 38, 40 for passing through the gun assembly streams of electrons emitted by the three cathodes 24 during operation of the tube.

Figure 3:
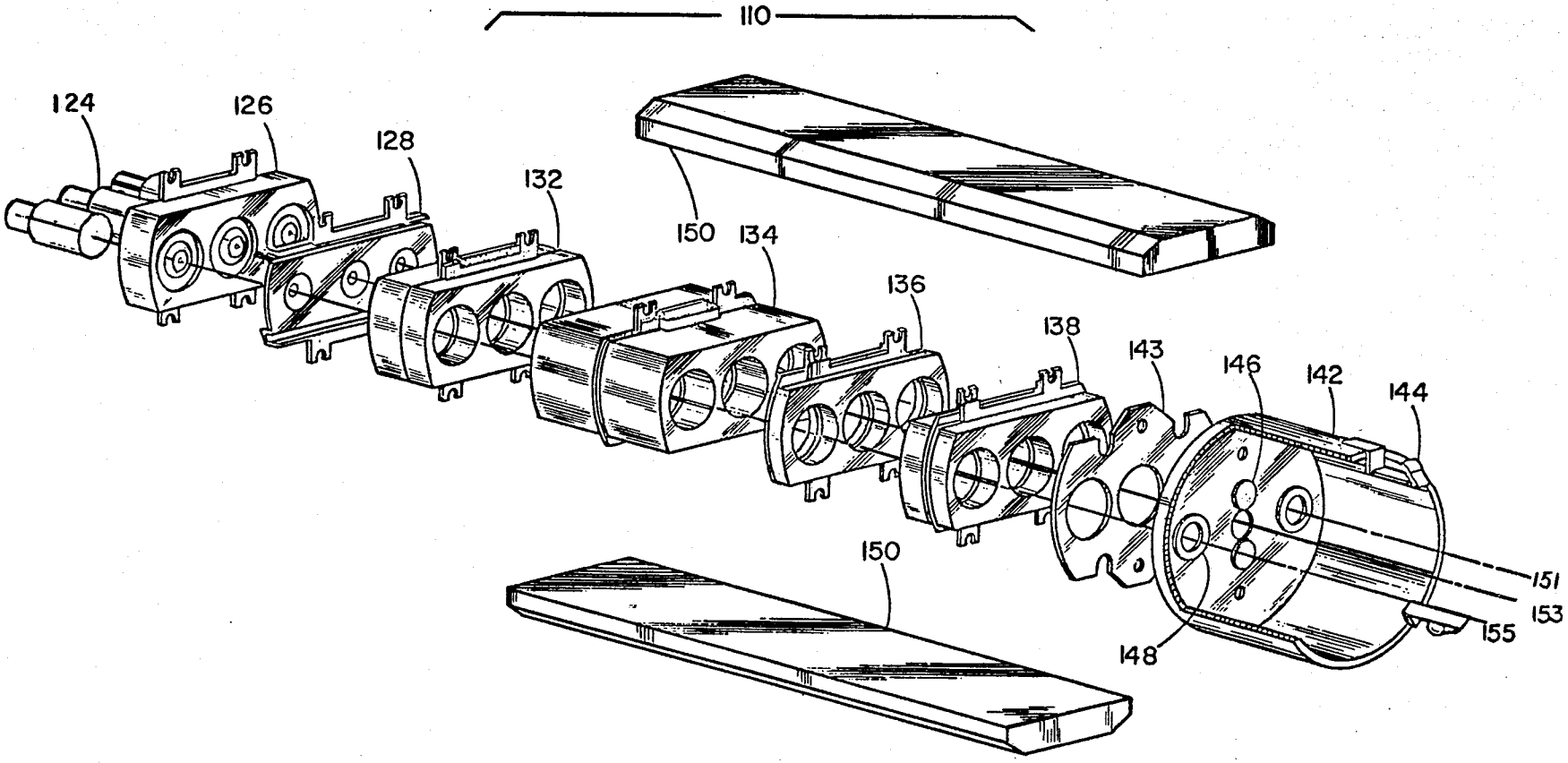
FIG. 3 is a perspective view of an in-line type electron gun for use in a color television picture tube.

More specifically, FIG. 3 shows an in-line type gun, generating three coplanar electron beams each of which is formed, shaped and directed to selectively energize phosphor elements located on the imaging screen in the expanded area at the opposite end of the cathode ray tube envelope (not shown).

The gun 110 has a tetrode section which generates three separate beam cross-overs (not shown), one for each of three beams 151, 153 and 155 (red-associated, blue-associated and green-associated). The tetrode section is comprised of four parts: separate cathodes 124 for each beam, a common control electrode 126 ("G1"), a common disc-type accelerating electrode 128 ("G2"), and a part of a common electrode 132 ("G3"); that is, the "lower end", or the end nearest the cathode.

Beam cross-overs are imaged on the screen of the cathode ray tube by respective main focus lens means. The main focus lens means for the three beams 151, 153 and 155 are unitized and constituted by the upper end section of common main focus electrode 132 and common main focus electrodes 134, 136 and 138. Each of these electrodes 132, 134, 136 and 138 is isolated from the others and receives predetermined voltages from a power supply to form a single extended main focusing field. The collection of unitized common main focus electrodes 132, 134, 136 and 138 are termed the "main focus lens" of the gun 110. The main focus lens means is described and claimed in U.S. Pat. No. 3,995,194. The structure of electrode 134 is described and claimed in copending application Ser. No. 834,029, filed Sept. 16, 1977. The term "main focus lens means" refers to the focus lens structure employed to focus a single beam. The term "main focus electrode means" refers to a discrete individual focus electrode for a single beam, or an allotted portion of a unitized electrode common to other beams.

Further with reference to FIG. 3, the last in the series of elements that comprise electron beam gun 110 is shield cup 142. shield cup 142 provides a mounting base for three contact springs 144 which center the forward end of the gun in the neck of the cathode ray tube. Also by contact with an electrically conductive coating on the inside of the neck of the tube, which is maintained at screen voltage, contact springs 144 convey the screen voltage through shield cup 142 to electrode 138 of the main focus lens. Located within the cavity formed by the shield cup 142, and adjacent to the apertures from which the three electron beams 151, 153 and 155 emerge, are enhancer magnets 146 and shunt magnets 148. Shield cup 142 is aligned and bonded to electrode 138 in precise registration by means of a carrier plate 143 which lies between the cup and electrode (described and claimed in copending application Ser. No. 649,630, filed Jan. 16, 1976). In the unitized, in-line gun described in this disclosure, the common electrodes 126, 128, 132, 134, 136 and 138 have on each side thereof at least one pair of widely spaced, relatively narrow claws embedded at widely spaced points in a wide bead 150 (described and claimed in copending application U.S. Pat. No. 4,023,811, issued June 28, 1977).

As noted, except for the three cathodes 124, the individual electrodes are "unitized"; that is, they each comprise one mechanical assembly having individual apertures for the three coplanar beams 151, 153 and 155. The gun electrodes are further characterized by having three effectively continuous, electrically shielding beam passageways extending completely through the electrodes, each passageway being formed by a contiguous axial succession of deep-drawn annular lips.

Whether the electron gun assembly contains one gun or three, the coaxial apertures in the electrodes and shield cup form beam passageways, and these beam passageways unavoidably form conduits for high velocity gas when the tube, especially a tube having a narrow neck, is evacuated during manufacture. During the manufacture of television picture tubes, after the tube is assembled, it is necessary to evacuate the tube of any air or gas which is in the tube (see FIG. 4). This is typically done by attaching a vacuum pum 42 to a tubulator 44 which is attached to a rear end of the neck 45 of a tube 46. When the tube 46 is evacuated, an electron gun 48 is already in position within the neck 45 of the tube 46. As the vacuum pump 42 removes the gas from the tube 46, the beam passageways in the gun 48 unavoidably form conduits for high velocity gas. Since the cathodes of the electron gun are necessarily positioned on the axis of the coaxial apertures of the gun, these beam passageways create a violent flow of gas over the cathodes.

It has been observed that during evacuation of the tube, the electron emissive coatings on the cathodes of the electron gun have been eroded. It is well known that the cathode coatings are sensitive to humidity in the atmosphere during evacuation of the tube and it is common practice to control the humidity within a narrow dew point window during evacuation. Typically the dew point is controlled between 40° F. to 50° F. If the humidity is too high the cathode coating may be eroded by particles of moisture bombarding the cathode during evacuation. This, coupled with high velocity during evacuation in the violent flow of gas through the narrow neck of the tube, results in serious erosion of the cathodes. This theory has been tested by injecting particles of carbon into the tube before evacuation. After the tube was evacuated carbon particles were observed on the cathode coatings of the electron gun and thus it is believed that the above theory is correct, that particles of moisture due to the drop in pressure within the tube and due to the violent flow of gas over the cathodes cause erosion of the cathode coatings. By the present invention gas is evacuated from the tube at a rate selected to produce a gas flow in the conduit in the region of the cathodes which has a relatively low velocity effective to reduce erosion of the cathode coatings.

In general terms this invention involves a method for use in the manufacture of a color television picture tube having a narrow neck wherein the neck has a front end joined with a flared portion of the tube and a rear end having an axially extending tubulator. The tube also has an electron gun having at least one cathode adjacent the rear end of the neck, the cathode having an electron emissive coating, a forward element adjacent the front end of the neck, and a plurality of electrodes interspaced between the cathode and the forward element. The electrodes and forward element each have at least one aperture wherein the aperture are coaxial. The apertures define a beam passageway for passing through the gun a stream of electrons emitted by the cathode during operation of the tube. The beam passageway unavoidably forms a gas conduit during evacuation of the tube. The method for suppressing erosion of the cathode coatings during evacuation of the tube, comprises; attaching a vacuum pump to the tubulator on the neck of the tube, and evacuating gas from the tube through the tubulator at a selected to produce rate a gas flow in the conduit in the region of the cathode, which has a relatively low velocity effective to reduce erosion of the cathode coatings during evacuation.

Figure 4:
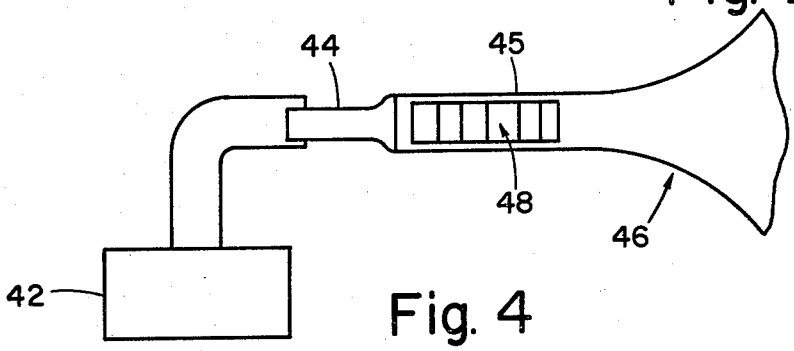
FIG. 4 is a schematic representation of a vacuum pump attached to a television picture tube during manufacture.

In a preferred embodiment of the present invention the mechanical vacuum pump 42 in FIG. 4 is operated at 100 r.p.m. for 5 minutes to evacuate gas from the tube 46 through the tubulator 44 at a rate effective to suppress erosion of the cathode coatings. The vacuum pump 42 is then operated at 525 r.p.m. for 1½hours in order to evacuate most of the remainig gas from the tube 46; after which the tube 46 is "tipped off", that is the tubulator 44 is sealed.

Figure 5:
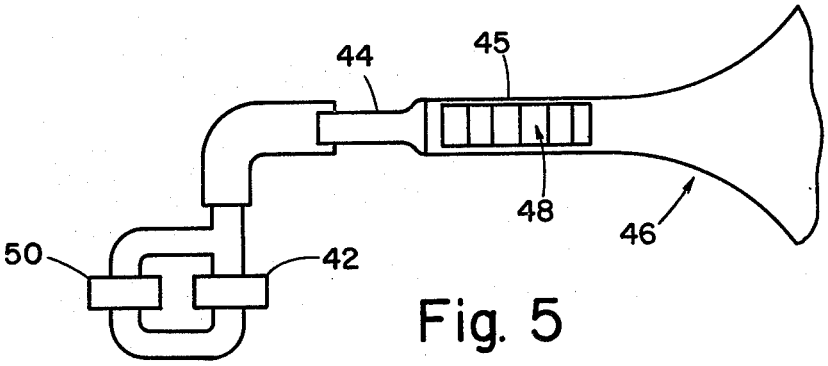
FIGS. 5—6 are schematic representations depicting two embodiments of the method of the present invention.

An alternative embodiment of the present invention is schematically illustrated in FIG. 5. A tube 46 has a neck 45 to which is attached a tubulator 44. The neck 45 contains an electron gun 48. A vacuum pump 42 is connected to the tubulator 44 and a by-pass valve 50 is connected to the vacuum pump 42. When evacuation of the tube 46 is initiated, the by-pass valve 50 is opened thereby partially by-passing vacuum pump 42. The vacuum pump 42 being partially by-passed, the evacuation of the tube 46 occurs at a sufficiently slow rate as to reduce or suppress erosion of the cathode coatings during the evacuation. It is during this initial evacuation that the high velocity flow of gas over the cathodes normally occurs and, due to the drop in pressure within the tube 46, any moisture particles which may be present within the tube 46 tend to condense on the cathode coatings of the electron gun 48. This condensation on the cathode coatings coupled with the initial high velocity gas flow over the cathodes is believed to cause the erosion of the cathode coatings.

At a predetermined reduced pressure of the gas within the tube 46, the by-passing of the vacuum pump 42 is discontinued by closing valve 50. Most of the remaining gas is then evacuated from the tube at a predetermined high pumping rate by the vacuum pump 42 which is now connected such that the full force of the vacuum pump 42 is applied to the gas within the tube 46.

Figure 6:
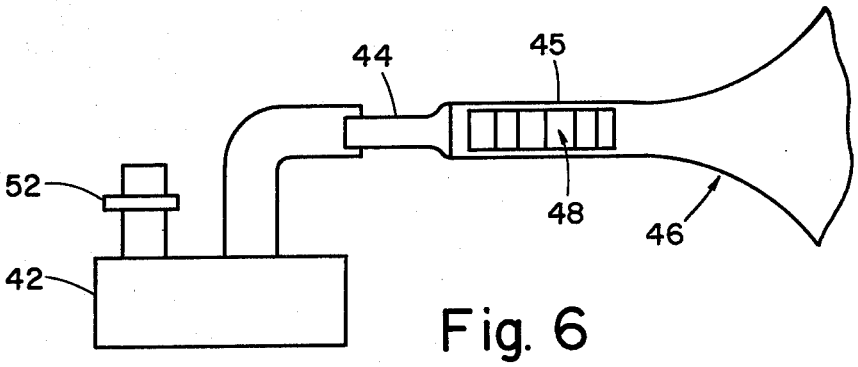

Another alternative embodiment of the present invention is schematically depicted in FIG. 6. As in the above-described method, the vacuum pump 42 is connected to the tubulator 44 on the neck 45 of the tube 46. In addition, a bleeder valve 52 is connected to the vacuum pump 42. When the vacuum pump 42 initiates the evacuation of gas from the tube 46, bleeder valve 52 is opened thus bleeding vacuum pump 42 to the external atmosphere. The vacuum pump 42 being bled, the evacuation of the tube 46 occurs at a rate selected to produce a gas flow in the conduits of electron gun 48 in the region of the cathodes which has a relatively low velocity effective to reduce erosion of the cathode coatings during the evacuation. The bleeding of the vacuum pump 42 is discontinued when the gas in the tube has fallen to a predetermined reduced pressure. The evacuation of the tube 46 is then continued at a predetermined higher rate until substantially most of the gas is evacuated from the tube 46.

The invention is not limited to the particular details of the method depicted and other modifications and applications are contemplated. Certain other changes may be made in the above-described method without departing from the true spririt and scope of the invention herein involved. It is intended therefore that the subject matter in the above depiction shall be interrupted as illustrative and not in a limiting sense.

I claim:

1. For use in evacuating a narrow-neck television tube enevlope having an electron gun in the neck section, a gas-evacuation program comprising:

attaching a vacuum pump to the tube's exhaust tubulation;

operating said pump in a first mode effective to evacuate said tube at a first rate during an intitial pump-down phase when gas volume in the tube is highest; and operating said pump in a second mode effective to evacuate said tube at a second higher rate during a subsequent pump-down phase when the gas volume is lower such that the gas velocity through said tubulation is at all times at a low value effective to suppress erosion of cathodes in the gun during evacuation.

2. For use in evacuating a narrow-neck television tube envelope having an electron gun in the neck section, a gas-evacuation program comprising:

attaching a vacuum pump to the tube's exhaust tubulation;

operating said pump in a first mode wherein said pump is partially bypassed to provide for evacuation of said tube at a first rate during an intitial pump-down phase when gas volume in the tube is highest; and, operating said pump in a second mode wherein said bypassing is discontinued to provide for the evacuating of said tube at a second higher rate during a subsequent pump-down phase when the gas volume is lower such that the gas velocity through said tubulation is at all times at a low value effective to suppression erosion of cathodes in the gun during evacuation.

3. For use in evacuating a narrow-neck television tube envelope having an electron gun in the neck section, a gas-evacuation program comprising:

attaching a vacuum pump to the tube's exhaust tubulation;

operating said pump in a first mode wherein said pump is operated when bleeding to the atmosphere to provide for evacuation of said tube at a first rate during an initial pump-down phase when gas volume in the tube is highest; and, operating said pump in a second mode wherein said bleeding is discontinued to provide for the evacuating of said tube at a second higher rate during a subsequent pump-down phase when the gas volume is lower such that the gas velocity through said tubulation is at all times at a low value effective to suppress erosion of cathodes in the gun during evacuation.

* * * * *